US005693186A

United States Patent [19]

Vallius

[11] Patent Number: 5,693,186

[45] Date of Patent: Dec. 2, 1997

[54] METHOD AND APPARATUS FOR INTERCONNECTING ROLLS IN AN EXTENDED-NIP PRESS

[75] Inventor: Oiva Vallius, Jyväskylä, Finland

[73] Assignee: Valmet Corporation, Helsinki, Finland

[21] Appl. No.: 598,728

[22] Filed: Feb. 8, 1996

[30] Foreign Application Priority Data

Feb. 10, 1995 [FI] Finland ..... 950580

[51] Int. Cl.[6] ..... D21F 3/02

[52] U.S. Cl. ..... 162/199; 72/238; 100/153; 100/168; 162/273; 162/358.3; 162/360.3

[58] Field of Search ..... 162/272, 273, 162/199, 358.3, 360.3; 100/153, 168, 163 R; 72/238

[56] References Cited

U.S. PATENT DOCUMENTS

| | | | |
|---|---|---|---|
| 2,157,455 | 5/1939 | Kimmel | 72/238 |
| 4,156,453 | 5/1979 | Scheinecker | 100/168 |
| 5,385,088 | 1/1995 | Grabscheid | 100/168 |
| 5,400,708 | 3/1995 | Meschenmoser | 162/273 |
| 5,404,811 | 4/1995 | Schiel et al. | 100/163 R |
| 5,507,223 | 4/1996 | Vallius | 100/168 |
| 5,547,547 | 8/1996 | Bengtsson | 162/272 |

FOREIGN PATENT DOCUMENTS 4140879 6/1993 Germany .

*Primary Examiner*—Karen M. Hastings
*Attorney, Agent, or Firm*—Steinberg, Raskin & Davidson, P.C.

[57] ABSTRACT

An apparatus for interconnecting rolls that form an extended nip in which the extended nip is formed by a back-up roll and an extended-nip roll having a loading shoe and loading members for pressing the loading shoe toward the back-up roll. A resilient belt mantle runs around the extended-nip roll and is pressed against the back-up roll. The extended-nip roll and the back-up roll are interconnected by coupling members at their bearing housings which include displaceable locking shafts.

22 Claims, 9 Drawing Sheets

METHOD AND APPARATUS FOR INTERCONNECTING ROLLS IN AN EXTENDED-NIP PRESS

FIELD OF THE INVENTION

The present invention relates to apparatus for interconnecting rolls that form an extended nip, e.g., in a press section of a paper machine, through which a paper web being formed is pressed to remove water therefrom.

The present invention also relates to a grouping of cylinders in a press section of a paper/board machine which are arranged to form at least one, and preferably two, extended nips.

BACKGROUND OF THE INVENTION

One particular feature characteristic of extended nips is the high linear loads formed in the extended nip to enable the web running therethrough to be dewatered, which loads are even up to about 1200 kN per meter of width. In such a case, it is nearly impossible to use a conventional screw or bolt joint to interconnect the rolls forming the extended nip, which is used to interconnect rolls forming nips other than extended nips, in view of its inadequacy to withstand such high linear loads. Such a bolt joint is shown, e.g., in FIGS. 5 and 6 in U.S. Pat. No. 2,157,455 (Kimmel), and connects a portion of the bearing housing of one roll to the bearing housing of the other connected roll.

OBJECTS AND SUMMARY OF THE INVENTION

It is an object of the present invention to provide a new and improved apparatus for interconnecting a pair of rolls forming a nip therebetween, which is especially applicable in a nip in which there is a high linear load during operation, such as an extended nip.

It is another object of the invention to provide a new and improved apparatus for interconnecting a pair of rolls in an extended nip through which a paper web runs.

It is another object of the present invention to provide a new and improved grouping of cylinders in a press section of a paper machine in which at least one extended nip is formed by a pair of adjacent press rolls.

To achieve these objects and others, a pair of rolls are interconnected by using separate connecting bolts or locking shafts which can be displaced into an open position of the pair of rolls, preferably by means of a hydraulic actuator. The bolts are passed through brackets of the nip rolls, and more particularly brackets connected to the bearing housings of the rolls, to lock the brackets together. The brackets are thus placed in an interlocking relationship with each other. Also, in the apparatus in accordance with the present invention, two connecting shafts, i.e., two pairs of brackets, are used to connect each adjacent pair of rolls to form a nip. The locking shaft passed through one of the pairs of brackets is connected with the brackets with play or an adjustable zone, whereby a certain play is permitted for the coupling in view of thermal expansion. The locking shaft passed through the other pair of brackets is not necessarily provided with play.

According to the invention, locking shafts are used that can be displaced by means of an actuator, preferably a hydraulic actuator, into at least an open position corresponding to an open position of the nip and a closed position corresponding to a closed position of the nip in which the nip rolls are locked. The actuator comprises a hydraulic cylinder which is attached to a frame part projecting from a face of the bracket. The locking shaft is displaceable from its locked or closed position to its open position in which it is situated within the frame part. Within the scope of the invention, an embodiment is also possible in which both of the pairs of brackets comprise a common actuator, which is connected with an arm part, in which case, when the actuator is activated, both of the locking shafts are displaced at the same time.

According to the invention, one of the nip rolls that form an extended nip is coupled with a transfer mechanism, which includes a cylinder device, by whose activation the nip roll can be brought apart from its adjoining backup roll after the locking shafts have been displaced to the open position and the locking between the rolls has been released.

In accordance with the invention, a construction of rolls is also described which comprises a center roll and extended-nip rolls jointly operative with the center roll. Thus, the extended-nip rolls jointly operative with the center roll constitute a unit of equipment or grouping by whose means two nips are formed. The bearing housing of the center roll comprises two coupling means on each side of the center roll, preferably pairs of brackets, for each extended-nip roll. Moreover, each of the extended-nip rolls comprises an arrangement of transfer cylinder, by means of which arrangement, after the locking has been opened, the extended-nip rolls can be shifted out of contact with the center roll.

After the extended-nip rolls have been brought apart from the center roll, after opening of the locking members, the extended-nip rolls are supported from their axles, for example, by means of the wire cables of a crane. Thereafter, the bolt locking or equivalent locking means is detached from between the bearing housings of the extended-nip rolls and the transfer-cylinder device. After this, the extended-nip rolls can be shifted away by means of crane devices or equivalent hoisting or lifting devices.

Thus, in its most basic embodiment, the apparatus for interconnecting the back-up roll and the extended-nip roll comprises locking means for releasably locking each of the bearing housings of the back-up roll to a respective one of the bearing housings of the extended-nip roll which have a first locking position in which the back-up roll and the extended-nip roll are interconnected and a second unlocking position in which the back-up roll and the extended-nip roll are movable relative to one another. The locking means comprise a locking shaft engaging with both the bearing housings of the back-up roll and the bearing housings of the extended-nip roll in each locked pair of bearing housings. In one embodiment, each of the bearing housings of the back-up roll includes a bracket and each of the bearing housings of the extended-nip roll includes at least one additional bracket. In this case, the locking means further comprise actuator means, e.g., a hydraulic cylinder, for displacing the locking shafts into connection with the brackets on both the bearing housings and into its locking position in which the brackets are locked to one another and into its unlocking position in which the brackets on the bearing housing of the back-up roll are movable relative to the brackets on the bearing housing of the extended-nip roll.

The grouping of extended-nip rolls in a press section of a paper/board machine in accordance with the invention comprises a back-up roll constituting a center roll of the press section, first bearing housings for supporting the shaft of the back-up roll, first and second extended-nip rolls each arranged in nip-defining relationship with the back-up roll, second bearing housings for supporting the shaft of the extended-nip rolls and locking means for releasably locking each of the first bearing housings to a respective one of the second bearing housings. The locking means have a first locking position in which the back-up roll and the extended-nip roll are interconnected and a second unlocking position in which the back-up roll and the extended-nip roll are movable relative to one another. The locking means comprise a locking shaft engaging with both the first and second bearing housings in each locked pair of first and second bearing housings. The grouping also includes transfer means arranged in connection with each of the extended-nip rolls for transferring a respective one of the extended-nip rolls between a position in which the extended-nip roll is in nip-defining relationship with the back-up roll and an open position in which the extended-nip roll is shifted out of connection with the back-up roll, and actuator means coupled to the transfer means for actuating the transfer means. The actuator means operate when the locking shafts of the locking means are moved out of engagement with each of the locked pairs of first and second bearing housings. Hoist means may be provided for suspending each of the extended-nip rolls after the extended-nip rolls have been shifted out of connection with the back-up roll and the second bearing housings are uncoupled from the extended-nip rolls.

The grouping can also include a lever mechanism for coupling the extended-nip rolls to the second bearing housings. Such a lever mechanism might include a hydraulic cylinder, a first intermediate lever mounted on the second bearing housing and the hydraulic cylinder, and a second intermediate lever mounted on the second bearing housing and on a frame of the paper/board machine.

The invention also relates to a method for interconnecting a back-up roll and an extended-nip roll having a loading shoe, a belt mantle running over the loading shoe and loading means for pressing the loading shoe and the belt mantle toward the back-up roll. The back-up roll has first bearing housings for supporting the ends of the shaft of the back-up roll and the extended-nip roll has second bearing housings for supporting the ends of the shaft of the extended-nip roll. The method basically includes the step of releasably locking each of the first bearing housings to a respective one of the second bearing housings whereby the locking means have a first locking position in which the back-up roll and the extended-nip roll are interconnected and a second unlocking position in which the back-up roll and the extended-nip roll are movable relative to one another. The locking means comprise a locking shaft engaging with both the first and second bearing housings in each locked pair of first and second bearing housings. In another embodiments of the method, the loading shoe is loaded in a loading direction toward the nip and the locking shafts are mounted such that a direction of the central axes of the locking shafts is perpendicular to the loading direction of the loading means. Also, it is possible to arrange the locking shafts symmetrically in relation to a nip plane defined as a plane running through a central axis of the extended-nip roll and a central axis of the back-up roll and orient the central axes of the locking shafts substantially parallel to the central axis of the extended-nip roll and the central axis of the back-up roll. In addition, each of the first bearing housings may be provided with a first bracket and each of the second bearing housings may be provided with at least a second bracket. The locking shafts are then selectively displaced into connection with the first and second brackets between its locking position in which the first and second brackets are locked to one another and its unlocking position in which the first brackets are movable relative to the second brackets. The locking shafts can also be passed into aligning through holes in the first and second bearing housing to thereby lock the first bearing housing to the second bearing housing in each locked pair of first and second bearing housings.

The invention will be described in the following with reference to some preferred embodiments of the invention illustrated in the figures in the accompanying drawings. However, the invention is not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
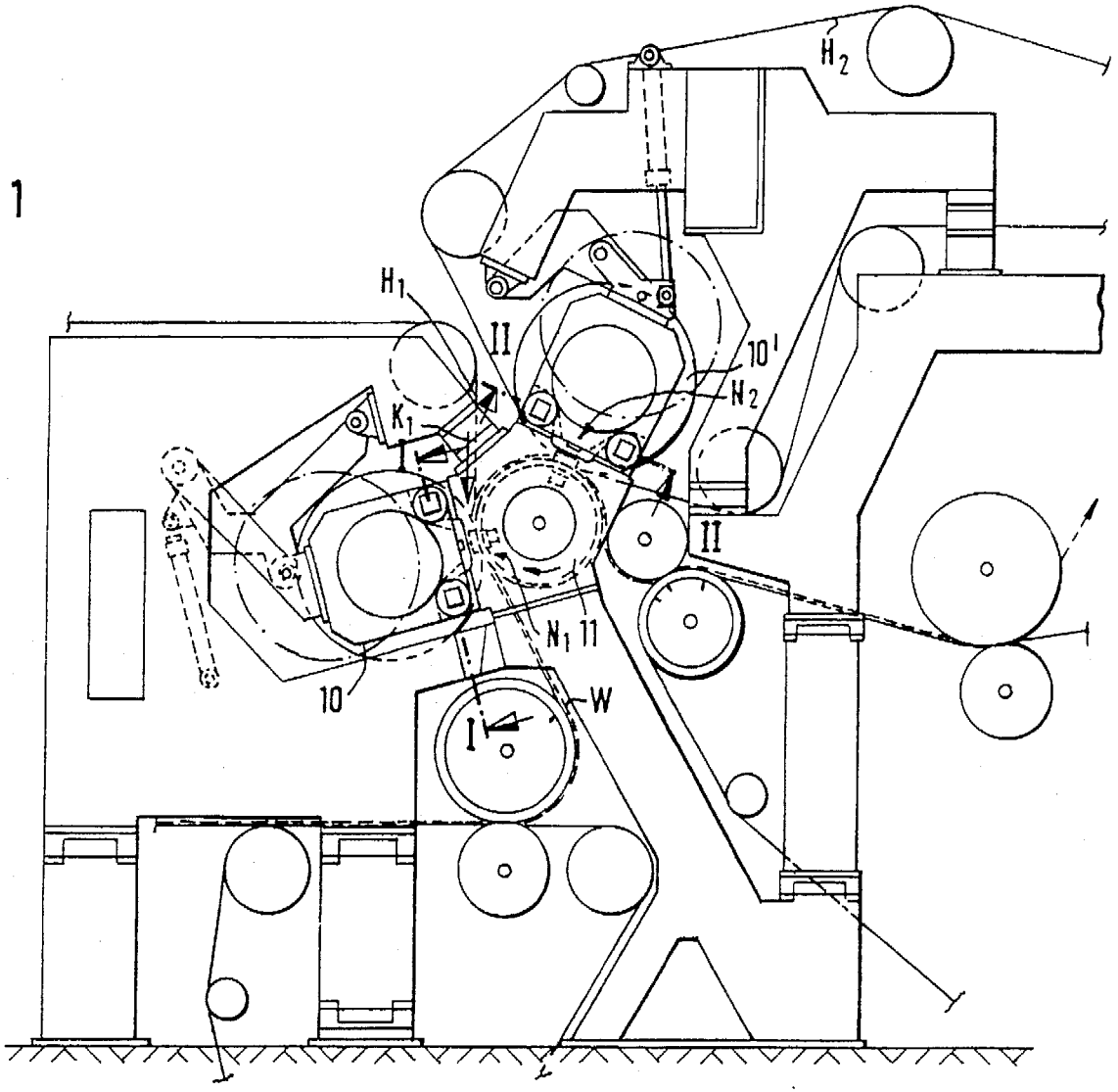
FIG. 1 shows an apparatus in accordance with the invention which comprises two extended-nip press rolls in contact with a backup roll, whereby two nips are formed, i.e., nips $N_1$ and $N_2$.
Figure 2A:
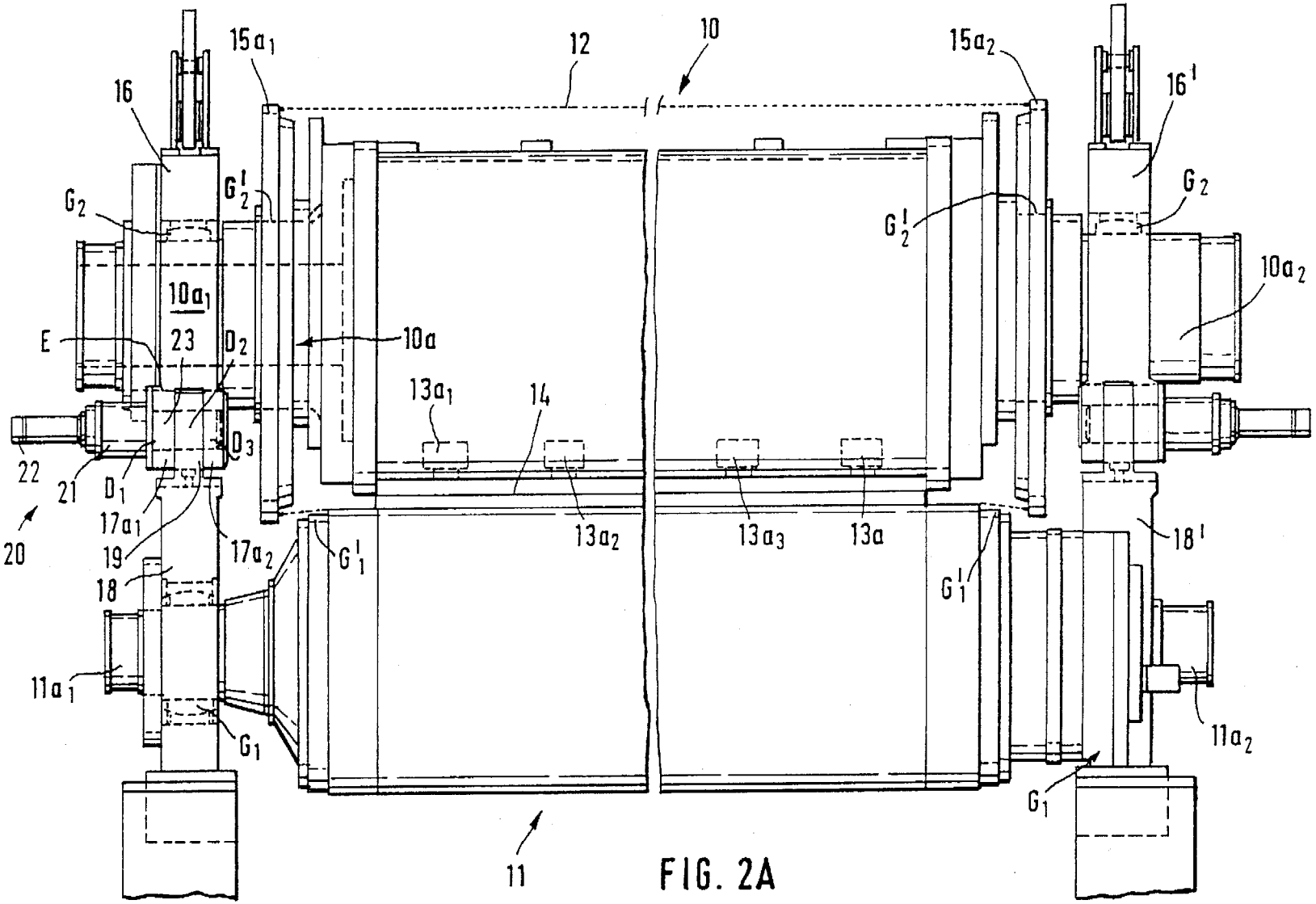
FIG. 2A shows the rolls that form the extended nip $N_2$, viewed in the direction of the arrow $K_1$ in FIG. 1.

Referring to the accompanying drawings wherein the same reference numerals refer to the same or similar elements, FIG. 1 shows a press section of a paper machine in which an apparatus in accordance with the invention is utilized. The press section of a paper machine includes a web draw denoted by reference W and felt draws denoted by references $H_1$ and $H_2$. The press section comprises a center roll 11 and two belt-mantle rolls 10 and 10' in nip-defining relationship with the center roll 11. Thus, the center roll 11 forms two nips with two belt-mantle rolls 10 and 10', i.e., the nips $N_1$ and $N_2$, at different circumferential locations. The center roll 11 can be a heated roll, for example a steam-heated roll having a substantially rigid outer surface, and the belt-mantle rolls 10,10' are preferably rolls which comprise a rotating belt mantle 12 and internal loading means, preferably loading cylinders $13a_1,13a_2$, . . . and a loading shoe 14 as shown in FIG. 2A whereby the loading shoe 14 is pressed from the roll interior by the loading cylinders 13*a* against the rotating belt mantle 12, while the outside backup roll, i.e., the center roll 11 in FIG. 1, is placed against the curved face of the belt mantle 12 shaped by the loading shoe 14. In this manner, the web runs over the rotating belt mantle 12 between the loading shoe 14 and the back-up roll 11. The loading shoe 14 is preferably lubricated by means of oil by any conventional lubricating means. The felt $H_1,H_2$ and the web W sandwiched therebetween are passed through the nips $N_1,N_2$.

In FIG. 2A, the apparatus in accordance with the invention is shown in the direction of the arrow $K_1$ in FIG. 1. As shown in FIG. 2A, the rolls 10' and 11 form the nip $N_2$ and the roll 10' is expressly a belt-mantle roll and the backup roll 11 is the center roll of the press section, which is preferably heated. The endless belt mantle 12 is resilient and attached at its longitudinal or axial sides to end flanges $15a_1,15a_2$, which are journalled to revolve in relation to a stationary central axle. The loading means, for example hydraulic cylinders $13a_1,13a_2$, load one continuous, axially extending loading shoe 14 including a curved face which thereby presses the belt mantle 12 against the face 11' of the backup roll 11, while the moving web W is placed between the belt mantle 12 and the curved roll-mantle face of the roll 11. Although only a single loading shoe 14 is shown, it is within the scope of the invention to provide a plurality of loading shoes, each one operated upon by at least one loading cylinder.

The axle journals of the central non-revolving axle of the belt-mantle roll 10 are denoted by $10a_1,10a_2$ and the end regions of the shaft 11*a* of the backup roll 11 are denoted by $11a_1,11a_2$. The axles $10a_1,10a_2$ of the belt-mantle roll 10 are supported in bearing housings 16,16', respectively, non-revolvingly, i.e., to prevent rotation, because the belt mantle 12 is rotated in relation to the central axle by means of bearing means $G'_2$ of its own placed in the area between the bearing housings 16,16' and the roll 10. Further, the bearing housings 16 and 16' comprise swivel bearings $G_2$ between a frame of the bearing housings 16,16' which is mounted on a frame construction of the press section and the axle journals $10a_1,10a_2$ The bearings $G_2$ permit bending of the axle 10*a*. The bearings $G'_2$ operate as the bearings of rotation proper of the belt mantle 12. Each of the bearing housings 16,16' includes brackets $17a_1,17a_2$, from which the bearing housing and thus the entire belt-mantle roll is coupled with a respective, aligning one of bearing housings 18 of the backup roll 11 of the nip $N_2$, as will be described in detail below. The bearing housings 18 of the back-up roll 11 each include swivel bearings $G_1$ arranged between a frame of the bearing housings 18 and the respective end region $11a_1,11a_2$ which permits a deflection angle of the central shaft 11*a* of the backup roll. The rotation proper of the mantle of the back-up roll takes place by means of bearing means $G'_1$ situated between the mantle of the back-up roll and the roll axle. Thus, the bearing housings 18 include rotation bearings $G'_1$, on whose support the roll 11 is rotated.

The belt-mantle roll 10 comprises loading means $13a_1$, $13a_2$ . . . , preferably hydraulically operating piston devices, which load the loading shoe/shoes against the belt mantle 12 and further against the backup roll 11 while the loading means are thus placed between the belt mantle 12 and the non-revolving central axle 10*a* of the roll 10. The loading means $13a_1,13a_2$ . . . in the belt-mantle roll 10 produce a high force which is received in the bearing housings 16,16', 18,18' by interconnecting aligning ones of the bearing housings. According to the invention, this takes place so that a bracket 19 of the roll 11, and more particularly a bracket 19 which is connected to the bearing housing of the roll 11, or possibly fixed with respect thereto, has been passed into connection with the brackets $17a_1,17a_2$ of the belt-mantle roll 10, more particularly brackets $17a_1,17a_2$ which are connected to the bearing housing of the roll 10, into a space E defined between these brackets, and a locking shaft 23 is then passed through aligning through holes $D_1,D_2,D_3$ provided in the brackets $_1$ $17a_2,17a,19$, respectively, in order to constitute a locking position in which the nip operates.

The locking shaft 23 forms part of a locking device 20 which is arranged between the rolls 10,11;10',11 and comprises a box frame 21 and a connected actuator 22, preferably a hydraulic cylinder, whose piston rod $22a_1$ is connected with the shaft 23. The shaft 23 is displaced in the interior of the box frame 21 of the actuator 20 when not actively locking the brackets together. The locking device 20 is connected from its box frame 21 to the bearing housing 16 of the belt-mantle roll 10, more particularly to an outer face of the bearing housing 16.

The locking shafts 23,23' are preferably substantially cylindrical and are placed in such a way in a locking situation that the direction of the central axes of the locking shafts 23,23' is substantially perpendicular to the direction of loading of the loading means, preferably loading shoes, in the loading nip defined by the rolls. With the arrangement and grouping of rolls in this manner, in a loading situation, no compression force or pulling force is applied to the locking shafts 23,23', but only shear forces are applied.

Moreover, in their locking position, the locking shafts 23,23' are placed in the brackets preferably substantially parallel to one another and, moreover, symmetrically in relation to the loading line of the loading shoes, i.e., to a nip plane defined as the plane running through a central axis of the center roll and the central axis of the back-up roll. In this position, moreover, the locking shafts 23,23' are preferably placed substantially parallel to the central axis of the extended-nip roll and to the central axis of the backup roll.

Figure 2B:
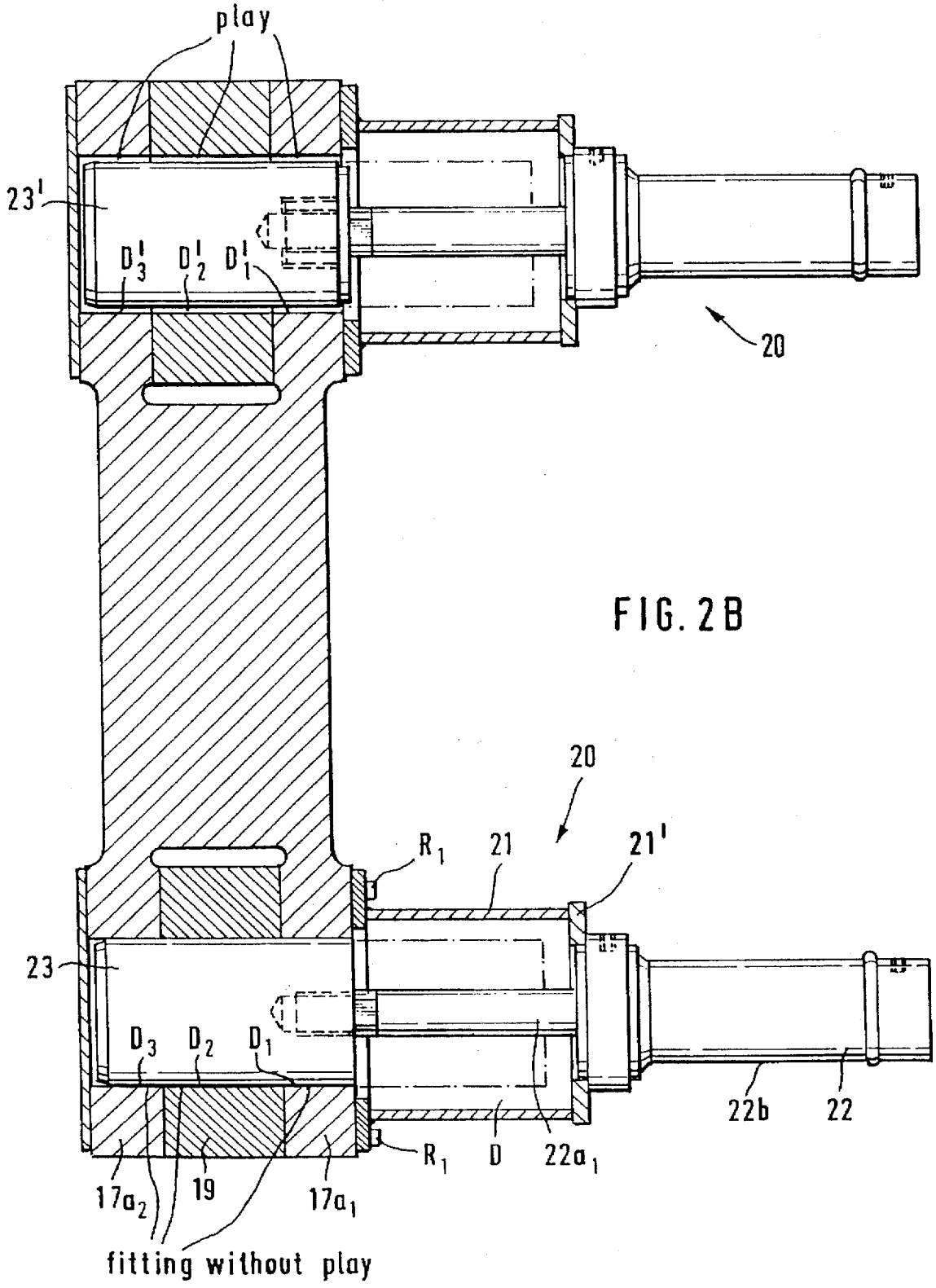
FIG. 2B is a sectional view taken along the line I—I in FIG. 1.

FIG. 2B is a sectional view taken along the line I—I in FIG. 1, and it corresponds to a sectional view taken along the line II—II in FIG. 1. In its locking position, the locking shaft 23 is passed through the holes $D_1$ and $D_2$ in the brackets $17a_1,17a_2$ of the bearing housing 16 and through the hole $D_3$ in the bracket 19 of the bearing housing 18 with a fitting without play. As shown in FIG. 2B, the actuator 20 comprises a frame 21, from which a hydraulic cylinder projects. The housing, i.e., the frame 21, encloses a space D, into which the shaft 23 can be displaced when the locking between the bearing housings 16 and 18 is opened, i.e., when the locking device is in an open position corresponding to an unlocked position of the nip rolls and the hydraulic actuator is not extended. Onto the top cover 21' of the box 21, the hydraulic actuator 22 is attached from its frame 22*b*. The box 21 is attached to an outer face of the bracket $17a_1$ of the bearing housing 16,16' by appropriate fastening means, for example, by means of screws $R_1,R_2$.

As shown in FIG. 2B, between the shaft 23 and the holes $D_1,D_2,D_3$ related to it, there is a fitting with no play, i.e., the diameter of the locking shafts substantially corresponds to the diameter of the holes $D_1,D_2,D_3$, whereas in the other bracket joint shown in the figure, between the shaft 23' and the related holes $D'_1,D'_2,D'_3$ in the brackets 17$a_1$,17$a_2$,19, there is a fitting with play, i.e., the diameter of the locking shaft is smaller than the diameter f the holes $D_1,D_2,D_3$. Thus, it is permitted by this construction that the joint may have a play in accordance with the requirements of thermal expansion so that internal strains are not produced in the construction as a result of inevitable thermal expansion of the components.

FIG. 2B shows a locking situation in which the shafts 23,23' are in the locked position in respect of each locking device 20, and the shafts 23,23' are illustrated by the dashed-dotted lines as being in the open position, in which the bearing housings 16,16',18,18' can be brought apart from one another.

Figure 3A:
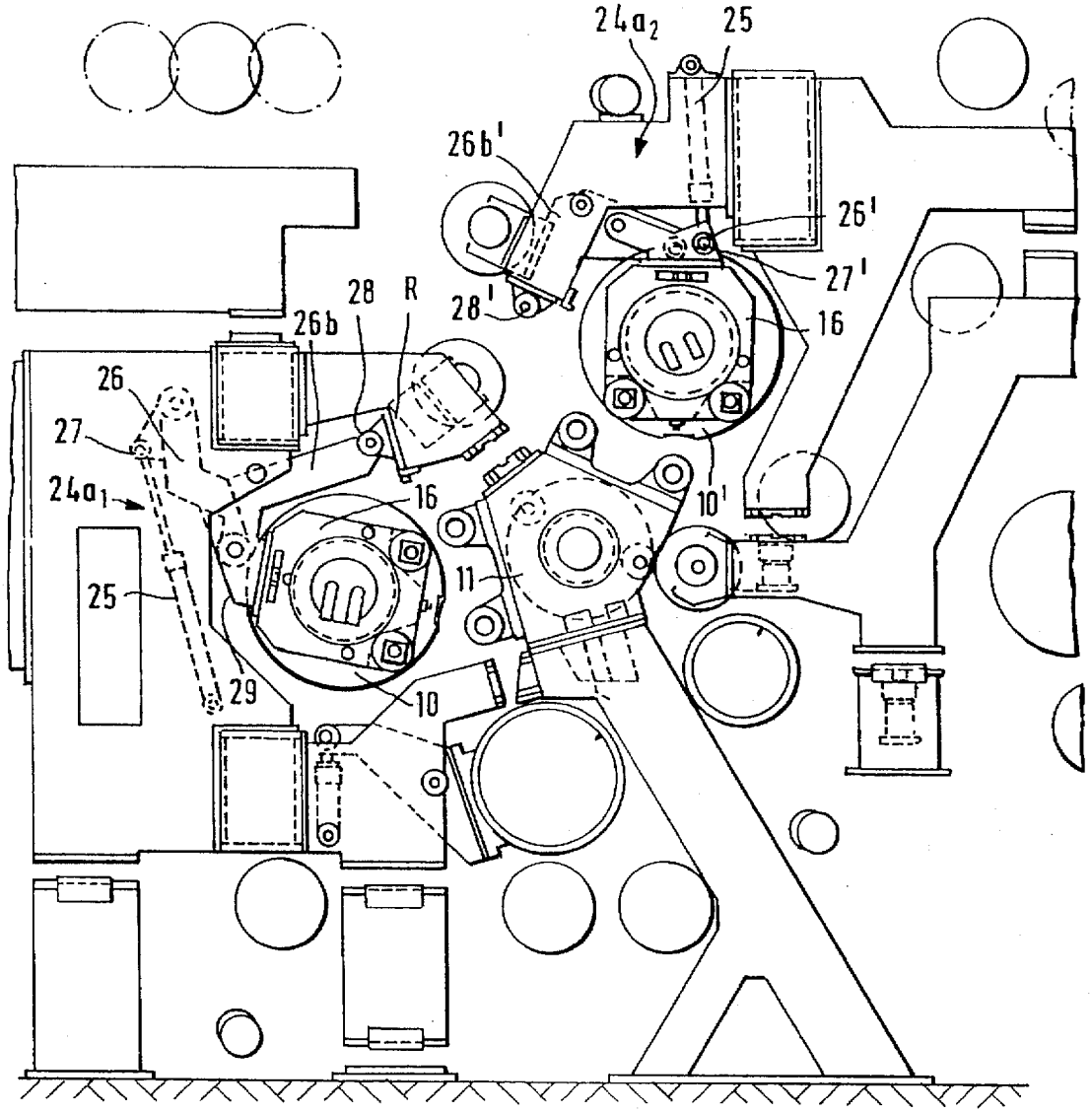
FIG. 3A shows the shifting of the extended-nip rolls out of contact with the center roll after the locking devices have been opened.

FIG. 3A shows a step following after FIG. 1 in the separation of the rolls 10,10' out of connection with the center roll 11. As shown in FIG. 3A, when the locking shafts 23,23' have been brought to the open or unlocked position of the locking device, the belt-mantle rolls 10 and 10' are shifted apart from the center roll 11 by means of the transfer cylinder devices 24$a_1$ and 24$a_2$. As shown in FIG. 3A, the transfer cylinder device 24$a_1$ comprises a cylinder 25 having a cylinder end attached to the machine frame and a piston rod attached to a pivot arm 26. Further, the pivot arm 26 is attached from its arm portion 26*b*, by means of an articulated joint, to the machine frame by bearing means 28. The bearing housing 10 is connected with a fixed arm 31 which is linked by means of an articulated joint 29 with the pivot arm 26 from its upper end and by means of an articulated joint 30 with the pivot arm 26. (The construction of the transfer cylinder device is shown in greater detail in FIG. 5A.) By operation of the cylinder 25, the belt-mantle roll 10 with its bearing housing 16 is shifted apart from the bearing housings 18 of the center roll 11. In the illustrated embodiment, this occurs upon extension of the piston rod from the cylinder 25. Other suitable means for transferring the extended-nip roll apart from the center roll and out of nip-defining relationship therewith may also be used without deviating from the scope of the invention.

Similarly, there is a second upper transfer cylinder equipment 24$a_2$, which comprises construction parts 25',26',27',28',24' and 30' corresponding to those of the transfer cylinder equipment 24$a_1$ and by whose means the other belt-mantle roll 10' can also be shifted apart from the center roll 11.

Figure 3B:
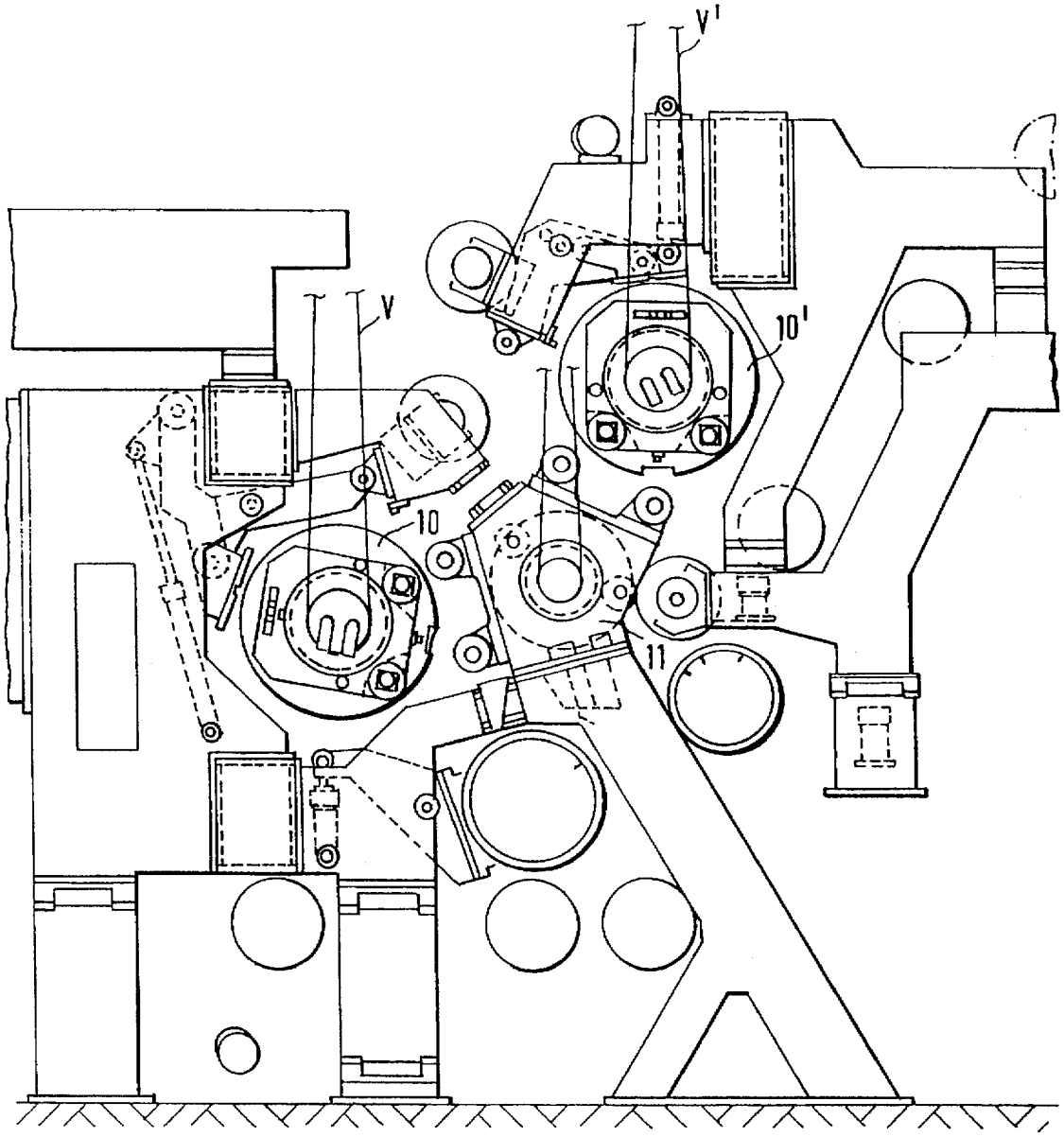
FIG. 3B shows the stage in which the coupling between the transfer device and the extended-nip press rolls has been opened and the extended-nip press rolls are suspended on the wire cables of a hoist device, after which the rolls can be shifted away.

FIG. 3B shows the stage of shifting away of the rolls, in which stage the rolls are supported from their axles by means of the wire cables V,V' of a hoist device or equivalent lifting device and in which stage, the rolls 10,10' can be shifted out of connection with the center roll 11 in the direction transverse to the machine direction.

Figure 4:
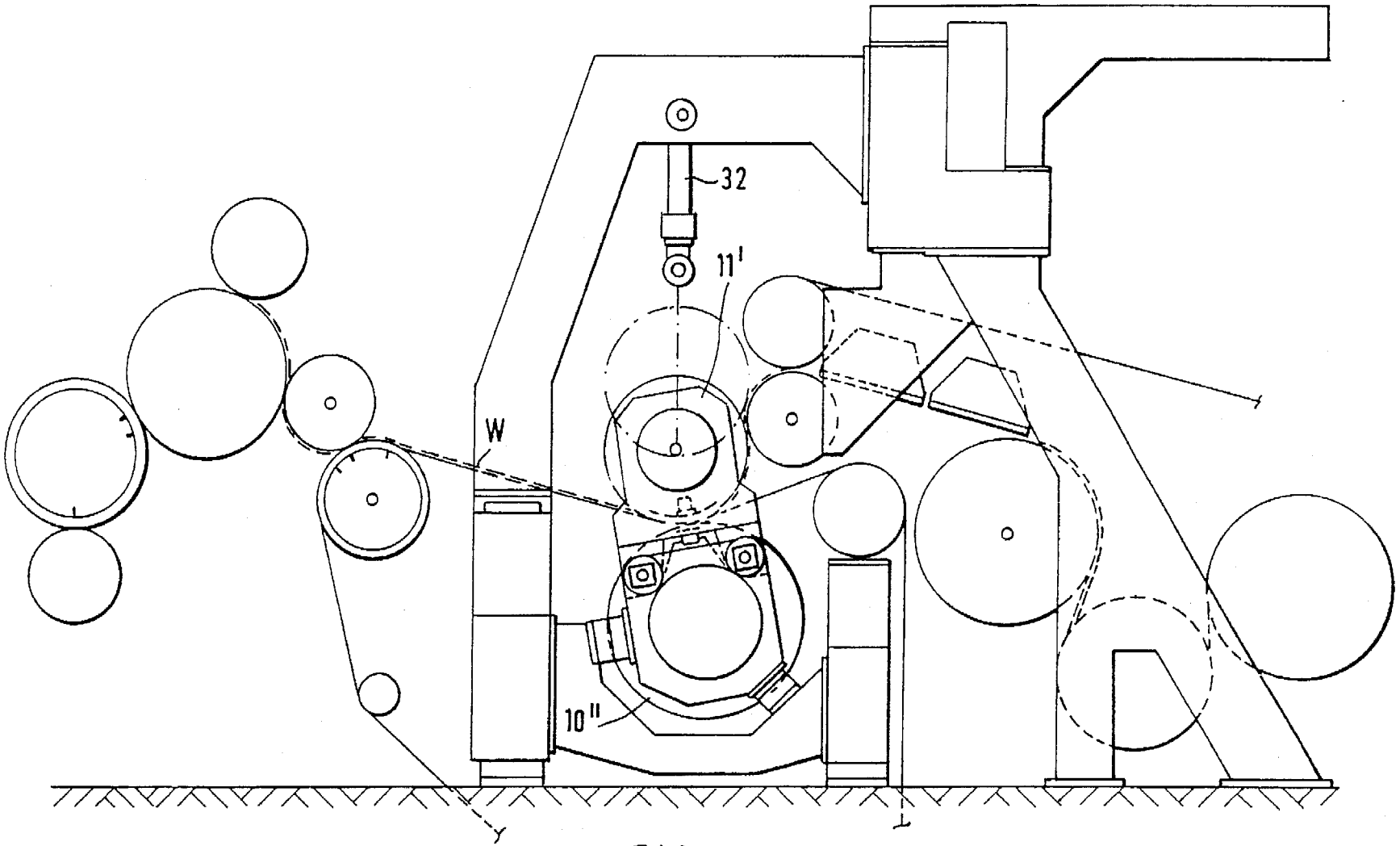
FIG. 4 shows an embodiment of the invention that comprises one nip defined by an extended-nip press roll and an upper backup roll, as well as an upper hydraulic actuator for lifting the upper roll out of nip-defining relationship with the lower extended-nip roll after the lockings between the rolls have been opened.

FIG. 4 shows an embodiment of the invention in which the press device has only one extended nip $N_3$ which is formed by means of an upper heated backup roll 11' and a lower belt-mantle roll 10". The upper machine frame R' includes a cylinder actuator 32 by whose means the upper backup roll 11' can be lifted apart from the lower belt-mantle roll 10" after the coupling between the extended-nip rolls 10",11' has been disengaged or opened by shifting the locking shafts 23 out of the holes $D_1,D_2,D_3$ in the brackets 17$a_1$,17$a_2$,19. In the embodiment of FIG. 4, the locking between the extended-nip roll and the backup roll is similar to that shown in FIG. 2B.

Figure 5A:
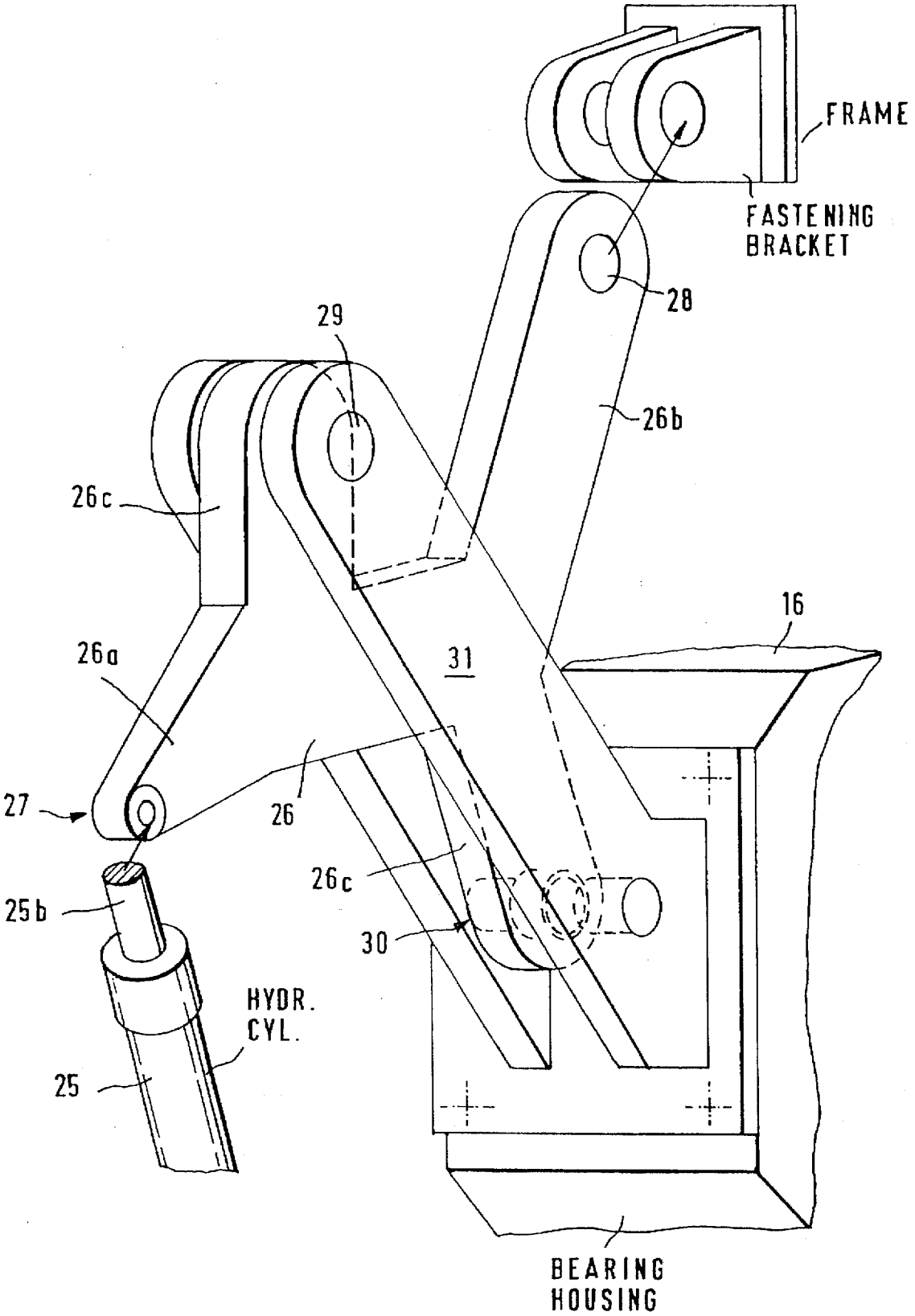
FIG. 5A is an axonometric view of a preferred embodiment of construction of the transfer device of the bearing housing in an apparatus in accordance with the invention.
Figure 5B:
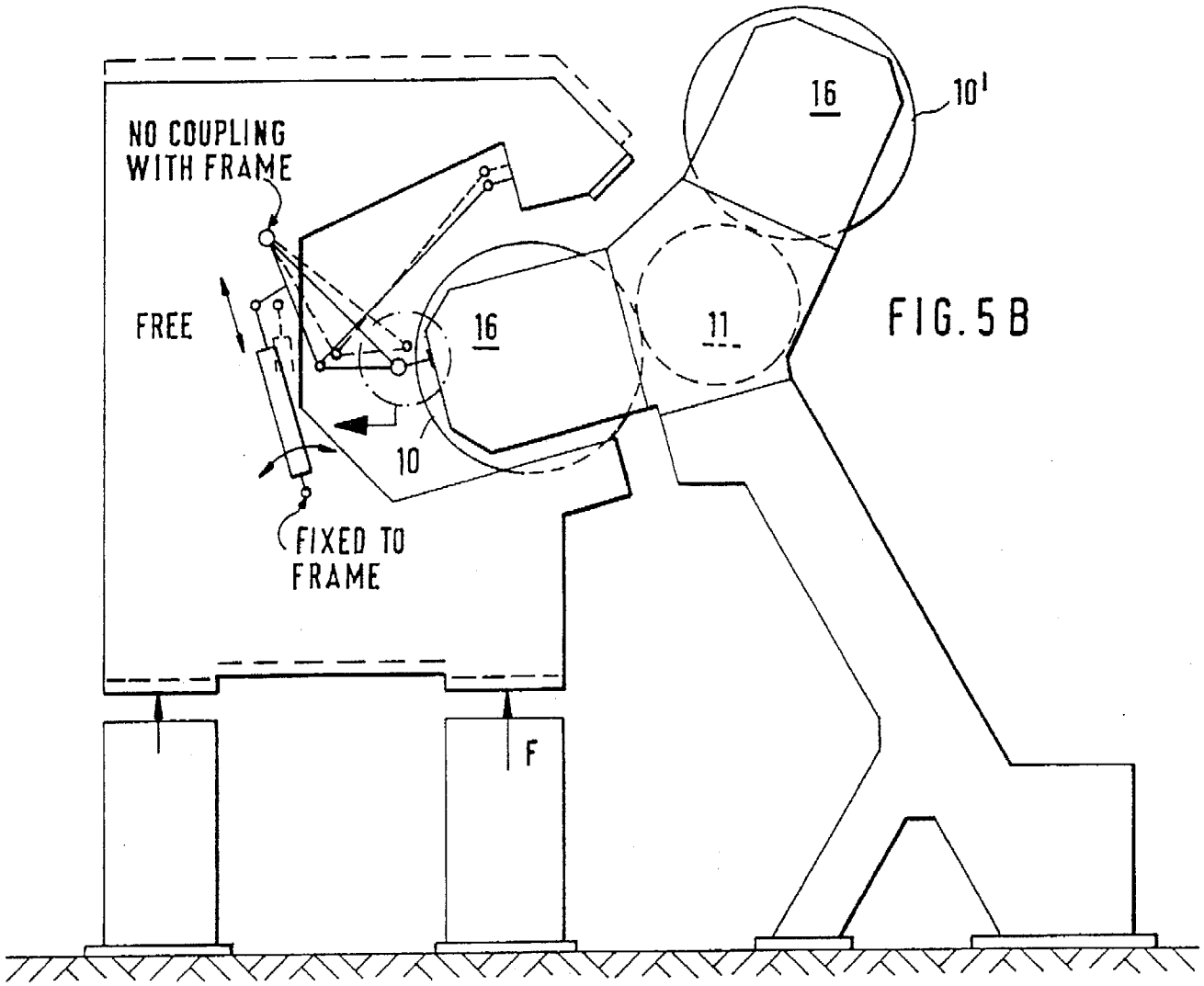
FIG. 5B illustrates deflection of the frame of the paper machine, for example, in connection with the removal of a felt, in which connection, by means of the play between the transfer device and the bearing housing, the operability of the device is permitted and it is ensured that the transfer device does not break the bearing housing.

FIG. 5A illustrates the fitting with play between the bearing housing 10 and the transfer cylinder device 24$a_1$. The articulated joint 30 between the pivot arm 26 and the arm 31 connected with the bearing housing 10 is provided with play in order to permit a certain movement between the part 26 and the bearing housing 10 when intermediate pieces are removed from between the frame parts of the paper machine while felts and wires are being replaced. Thus, the play between the pivot arm 26 and the bearing housing 10 in the joint 30 makes it possible that the arm 26 does not break the bearing housing 10 as a result of displacements that may occur in the frame in connection with replacement of felt. As shown in FIG. 5A, the transfer cylinder device 24$a_1$ comprises a hydraulic cylinder 25, which is connected from its piston rod 25*a* by means of the articulated joint 27 with the arm portion 26*a* of the pivot arm 26. Similarly, the arm portion 26*b* of the pivot arm 26 is connected with the machine frame by means of the articulated joint 28 through the fastening bracket. The arm portion 26*b* of the pivot arm 26 is connected, by means of an articulated joint 29, with the top end of a stationary arm 31 connected with the bearing housing 10. The pivot-arm portion 26*c* of the pivot arm 26 is connected with the lower end of the arm portion 31 of the bearing housing 10 by means of an articulated joint 30. The articulated joint 30, e.g., the shaft joint between the arm 31 and the arm portion 26*c* of the pivot arm 26, is fitted with a play, which permits a movement of pivoting of the pivot arm 26 before the pivot arm 26 starts bearing.

Figure 5C:
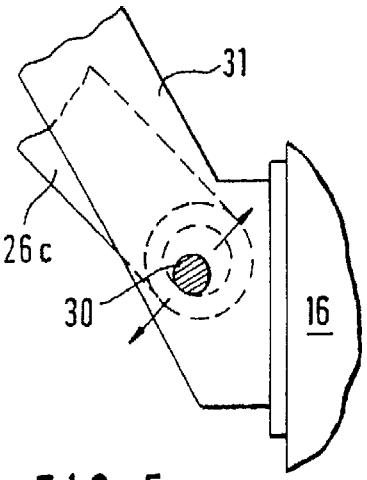
FIG. 5C illustrates the fitting with a play between the bearing housing and the arm of the transfer device.

FIG. 5C illustrates the deflection that the frame undergoes after removal of the intermediate pieces when wires or felts are being replaced. Then, the play at the articulated joint 30 permits that the construction 26 is not bearing in a normal situation of operation or in situations of replacement of felt, in which displacements arise in the machine frame.

FIG. 5C illustrates the articulated joint 30 and the relatively large degree of play or movability present in it. The degree of movability or play is adjustable in accordance with the operating situation and construction parameters of the extended-nip and press section in general.

Figure 5D:
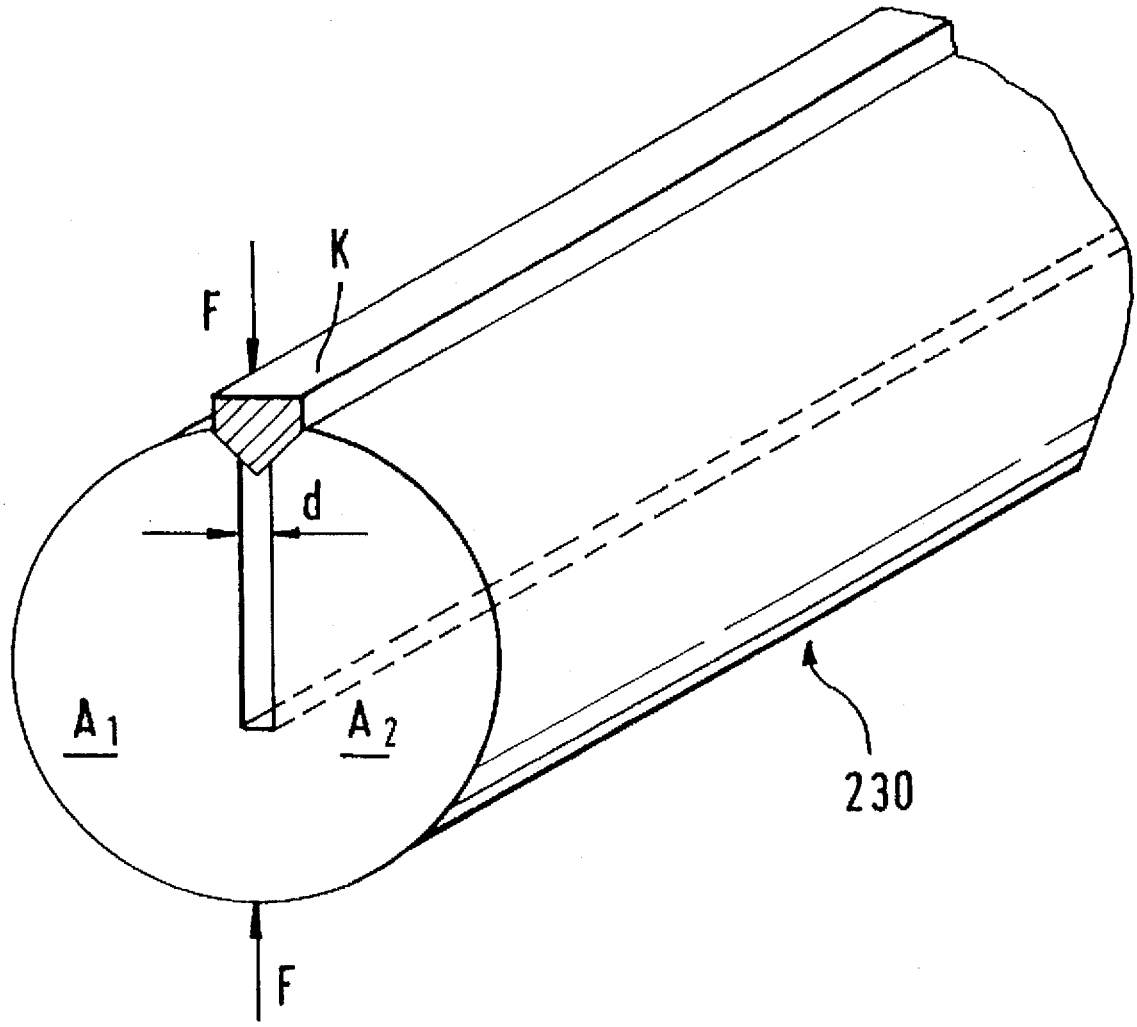
FIG. 5D illustrates a second embodiment of the locking shaft.

FIG. 5D shows an embodiment of the invention in which the locking shaft 230 is a partly split construction, i.e., there is longitudinal or axial groove d in the locking shaft 230. A wedge K acts upon the split groove d. When the loading is on in the nip, the wedge K has a widening effect on the shaft 230 halves $A_1,A_2$ in which case the play between the bracket holes and the shaft is eliminated. When the nip between the rolls is unloaded, the loading forces are eliminated and the play is restored between the shaft and the bracket hole.

The examples provided above are not meant to be exclusive. Many other variations of the present invention would be obvious to those skilled in the art, and are contemplated to be within the scope of the appended claims.

I claim:

1. In an extended nip defined by a back-up roll and an extended-nip roll having a loading shoe, a belt mantle running over the loading shoe and loading means for pressing the loading shoe and the belt mantle toward the back-up roll, the back-up roll having a first bearing housing at each end for supporting the respective end thereof, the extended-nip roll having a second bearing housing at each end for supporting the respective end thereof, an apparatus for interconnecting the back-up roll and the extended-nip roll comprising locking means for releasably locking each of said first bearing housings to a respective one of said second bearing housings, said locking means having a first locking position in which the back-up roll and the extended-nip roll are interconnected and a second unlocking position in which the back-up roll and the extended-nip roll are movable relative to one another, said locking means comprising a substantially cylindrical locking shaft engaging with each of said first bearing housings and the respective one of said second bearing housings, each of said first bearing housings comprising a first bracket and each of said second bearing housings comprising second and third brackets, said first bracket engaging with said second and third brackets when the back-up roll is in nip-defining relationship with the extended-nip roll, said first, second and third brackets each including a through hole, said locking shafts being passed into said through holes to thereby lock each of said first bearing housings to the respective one of said second bearing housings.

2. The apparatus of claim 1, wherein the loading means are structured and arranged to load the loading shoe in a loading direction toward the nip, said locking shafts being oriented such that a direction of the central axes of said locking shafts is perpendicular to the loading direction of the loading means.

3. The apparatus of claim 1, wherein said locking shafts are arranged symmetrically in relation to a nip plane defined as a plane running through a central axis of the extended-nip roll and a central axis of the back-up roll, the central axes of said locking shafts being substantially parallel to the central axis of the extended-nip roll and the central axis of the back-up roll.

4. The apparatus of claim 3, wherein the extended-nip roll includes a stationary axle having axle journals, said axle journals being non-revolvingly supported by said second bearing housings, and third bearing means for rotatingly supporting the belt mantle on said axle.

5. The apparatus of claim 1, wherein said second and third brackets are spaced from one another, said first bracket being passed into a space between said second and third brackets.

6. The apparatus of claim 1, wherein said locking means further comprises actuator means for displacing said locking shafts into connection with said first, second and third brackets and into its locking position in which said first, second and third brackets are locked to one another and into its unlocking position in which said first brackets are movable relative to said second and third brackets.

7. The apparatus of claim 6, wherein said actuator means comprise a hydraulic cylinder.

8. The apparatus of claim 7, wherein said hydraulic cylinder includes a piston rod connected to said locking shaft, said locking shaft being displaced upon movement of said piston rod.

9. The apparatus of claim 1, wherein each of said locking means further comprises a box frame having a cover and an interior in which said locking shaft is displaceable, coupling means for coupling said box frame to one of said second bearing housings, and a hydraulic actuator attached to said cover of said box frame.

10. The apparatus of claim 1, wherein at least one of said locking shafts has a diameter smaller than a diameter of cooperating ones of said through holes to provide a degree of play in the engagement of said at least one locking shaft and the cooperating ones of said through holes.

11. The apparatus of claim 1, wherein at least one of said locking shafts has a longitudinal groove, further comprising a wedge insertable into said longitudinal groove for applying a widening force on portions of said locking shaft on both sides of said longitudinal groove.

12. In an extended nip defined by a back-up roll and an extended-nip roll having a loading shoe, a belt mantle running over the loading shoe and loading means for pressing the loading shoe and the belt mantle toward the back-up roll, the back-up roll having first bearing housings for supporting the back-up roll, the extended-nip roll having second bearing housings for supporting the extended-nip roll, an apparatus for interconnecting the back-up roll and the extended-nip roll comprising locking means for releasably locking each of said first bearing housings to a respective one of said second bearing housings, said locking means having a first locking position in which the back-up roll and the extended-nip roll are interconnected and a second unlocking position in which the back-up roll and the extended-nip roll are movable relative to one another, said locking means comprising first and second substantially cylindrical locking shafts which cooperate with a locking space defined in a respective member fixed with respect to each of said first bearing housings and the respective one of said second bearing housings when said locking means is in the first locking position, said first and second locking shafts being arranged symmetrically in relation to a nip plane defined as a plane running through a central axis of the extended-nip roll and a central axis of the back-up roll, the central axes of said first and second locking shafts being substantially parallel to the central axis of the extended-nip roll and the central axis of the back-up roll.

13. A grouping of extended-nip rolls in a press section of a paper/board machine, comprising a back-up roll constituting a center roll of the press section, a first bearing housing arranged at each end of said back-up roll for supporting the respective end thereof, each of said first bearing housings including a bracket fixed with respect to said first bearing housing and a through hole arranged in said bracket, first and second extended-nip rolls each arranged in nip-defining relationship with said back-up roll, a second bearing housings arranged at each end of each of said extended-nip rolls for supporting the respective end of each of said extended-nip rolls, each of said second bearing housings including at least one additional bracket fixed with respect to said second bearing housing and a through hole arranged in said at least one additional bracket, locking means for releasably locking each of said first bearing housings to a respective one of said second bearing housings, said locking means having a first locking position in which the back-up roll and the extended-nip roll are interconnected and a second unlocking position in which the back-up roll and the extended-nip roll are movable relative to one another, said locking means comprising a substantially cylindrical locking shaft engaging with each of said first bearing housings and the respective one of said second bearing housings, each of said locking shafts being passed into said through holes in said bracket in one of said first bearing housings and said at least one additional bracket in the respective one of said second bearing housings to thereby lock each of said first bearing housings to the respective one of said second bearing housings, transfer means arranged in connection with each of said extended-nip rolls for transferring a respective one of said extended-nip rolls between a position in which said extended-nip roll is in nip-defining relationship with said back-up roll and an open position in which said extended-nip roll is shifted out of connection with said back-up roll, and actuator means coupled to said transfer means for actuating said transfer means, said actuator means operating when said locking shafts of said locking means are moved out of engagement with each of the locked pairs of said first and second bearing housings.

14. The grouping of claim 13, further comprising hoist means for suspending each of said extended-nip rolls after said extended-nip rolls have been shifted out of connection with said back-up roll and said second bearing housings are uncoupled from said extended-nip rolls.

15. The grouping of claim 13, further comprising a lever mechanism for coupling each of said extended-nip rolls to a respective one of said second bearing housings, said lever mechanism comprising a hydraulic cylinder, a first intermediate lever mounted on the respective one of said second bearing housings and said hydraulic cylinder, and a second intermediate lever mounted on the respective one of said second bearing housings and on a frame of the paper/board machine.

16. A method for interconnecting a back-up roll and an extended-nip roll having a loading shoe, a belt mantle running over the loading shoe and loading means for pressing the loading shoe and the belt mantle toward the back-up roll, the back-up roll having a first bearing housing at each end for supporting the respective end thereof, the extended-nip roll having a second bearing housing at each end for supporting the respective end thereof, comprising the steps of:

releasably locking each of said first bearing housings to a respective one of said second bearing housings by engaging first and second substantially cylindrical locking shafts with a respective member fixed with respect to each of said first bearing housings and the respective one of said second bearing housings, said locking means having a first locking position in which the back-up roll and the extended-nip roll are interconnected and a second unlocking position in which the back-up roll and the extended-nip roll are movable relative to one another, arranging said first and second locking shafts symmetrically in relation to a nip plane defined as a plane running through a central axis of the extended-nip roll and a central axis of the back-up roll, and orienting the central axes of said first and second locking shafts substantially parallel to the central axis of the extended-nip roll and the central axis of the back-up roll.

17. The method of claim 16, further comprising the steps of:

loading the loading shoe in a loading direction toward the nip, and mounting said first and second locking shafts such that a direction of the central axes of said first and second locking shafts is perpendicular to the loading direction.

18. The method of claim 16, further comprising the steps of:

providing each of said first bearing housings with a first bracket at first and second locations, said first bracket constituting said member fixed with respect to said first bearing housing, providing each of said second bearing housings with at least a second bracket at first and second locations, said second bracket constituting said member fixed with respect to said second bearing housing, selectively displacing said first and second locking shafts into connection with said first and second brackets at a respective one of the first and second locations between its locking position in which said first and second brackets are locked to one another and its unlocking position in which said first brackets are movable relative to said second brackets.

19. The method of claim 18, further comprising the step of:

passing said first and second locking shafts into aligning through holes in said first and second brackets to thereby lock each of said first bearing housing to the respective one of said second bearing housings.

20. In an extended nip defined by a back-up roll and an extended-nip roll having a loading shoe, a belt mantle running over the loading shoe and loading means for pressing the loading shoe and the belt mantle toward the back-up roll, the back-up roll having a first bearing housing at each end for supporting the respective end thereof, the extended-nip roll having a second bearing housing at each end for supporting the respective end thereof, an apparatus for interconnecting the back-up roll and the extended-nip roll comprising locking means for releasably locking each of said first bearing housings to a respective one of said second bearing housings, said locking means having a first locking position in which the back-up roll and the extended-nip roll are interconnected and a second unlocking position in which the back-up roll and the extended-nip roll are movable relative to one another, said locking means comprising a substantially cylindrical locking shaft engaging with each of said first bearing housings and the respective one of said second bearing housings, each of said first bearing housings including a first bracket and each of said second bearing housings including at least a second bracket, said first and second brackets each including a through hole, said locking shafts being passed into said through holes to thereby lock said first bearing housing to said second bearing housing in each locked pair of said first and second bearing housings, at least one of said locking shafts having a diameter smaller than a diameter of cooperating ones of said through holes to provide a degree of play in the engagement of said at least one locking shaft and the cooperating ones of said through holes.

21. In an extended nip defined by a back-up roll and an extended-nip roll having a loading shoe, a belt mantle running over the loading shoe and loading means for pressing the loading shoe and the belt mantle toward the back-up roll, the back-up roll having a first bearing housing at each end for supporting the respective end thereof, the extended-nip roll having a second bearing housing at each end for supporting the respective end thereof, an apparatus for interconnecting the back-up roll and the extended-nip roll comprising locking means for releasably locking each of said first bearing housings to a respective one of said second bearing housings, said locking means having a first locking position in which the back-up roll and the extended-nip roll are interconnected and a second unlocking position in which the back-up roll and the extended-nip roll are movable relative to one another, said locking means comprising a substantially cylindrical locking shaft engaging with each of said first bearing housings and the respective one of said second bearing housings, each of said first bearing housings including a first bracket and each of said second bearing housings including at least a second bracket, said locking means further comprising actuator means for displacing said locking shafts into connection with said first and second brackets and into its locking position in which said first and second brackets are locked to one another and into its unlocking position in which said first brackets are movable relative to said second brackets.

22. The apparatus of claim 21, wherein said actuator means comprise a hydraulic including a piston rod connected to said locking shaft, said locking shaft being displaced upon movement of said piston rod.

* * * * *